United States Patent [19]

Samson

[11] 4,410,213

[45] Oct. 18, 1983

[54] CONVERTIBLE CHAIR

[76] Inventor: Ilan Samson, 62, Eshkol St., Tel-Aviv, Israel

[21] Appl. No.: 271,228

[22] Filed: Jun. 8, 1981

Related U.S. Application Data

[63] Continuation of Ser. No. 62,958, Aug. 2, 1979.

[30] Foreign Application Priority Data

Aug. 7, 1978 [IL] Israel ..... 55298

[51] Int. Cl.[3] ..... A47C 1/02; A61G 15/00

[52] U.S. Cl. ..... 297/84; 297/90; 297/319

[58] Field of Search ..... 297/319, 317, 318, 90, 297/84, 85, 83, 82

[56] References Cited

U.S. PATENT DOCUMENTS

| | | | |
|---|---|---|---|
| 1,026,074 | 5/1912 | Cain | 297/317 X |
| 1,028,548 | 6/1912 | Cromer | 297/319 |
| 1,846,797 | 2/1932 | Decker | 297/319 |
| 2,492,106 | 12/1949 | Orton | 297/318 |
| 2,492,117 | 12/1949 | Roman | 297/318 |
| 2,508,598 | 5/1950 | Dean et al. | 297/318 X |
| 2,579,502 | 12/1951 | Lorenz | 297/319 X |
| 2,633,181 | 3/1953 | Bell | 297/317 |
| 2,712,346 | 7/1955 | Sprinkle | 297/317 X |
| 2,870,822 | 1/1959 | Luckhardt | 297/85 |
| 2,895,538 | 7/1959 | Lorenz | 297/85 |
| 3,094,353 | 6/1963 | Mizelle | 297/85 |
| 3,139,305 | 6/1964 | Mizelle | 297/317 |
| 3,433,527 | 3/1969 | Re' | 297/85 |

*Primary Examiner*—James T. McCall

[57] ABSTRACT

A convertible chair which is adjustable between sitting and reclining positions features a support frame, a seat and a backrest in which the seat and backrest are tiltably mounted so that their relative inclinations can be adjusted to define the afore-mentioned sitting and reclining positions and also a series of intermediate positions. The adjustment mechanism is defined by a support element with a curved support surface which forms a support for the seat and which is pivotably mounted to the support frame at a distance from the pivot axis of the seat and a control linkage which extends between the backrest, or an extension thereof, and the support element so that on changing the inclination of the backrest the support element rotates about its pivot mount and adjusts the vertical height of the point of support of the seat.

In modifications the control linkage can conveniently form part of an armrest of the chair and the mechanism is further adapted to deploy a leg support mechanism to move a legrest from a stowed position at the front of the chair to a position for supporting the legs of an occupant of the chair when the chair is in a reclined or semi-reclined position.

A single support element can be provided substantially on the center-line of the seat or a pair of support elements can usefully be provided one to either side of the seat.

13 Claims, 8 Drawing Figures

CONVERTIBLE CHAIR

Figure 1:
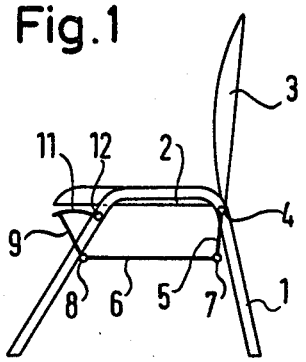

This is a continuation, of application Ser. No. 062,958, filed Aug. 2, 1979.

The invention relates to a convertible chair which is adjustable between sitting and reclining positions and which comprises a support frame, a seat and a backrest of which the seat and the backrest are tiltably mounted and are coupled together via parts of an adjustment mechanism which are tiltable relative to one another.

Convertible chairs of this kind are known and the associated adjustment mechanisms make it possible for the user of the convertible chair to produce an adjustment between the sitting and lying positions by displacement of his weight and/or by exerting pressure on the backrest. Certain adjustment mechanisms which are likewise known make provision for a further semi-reclining position which is defined between the sitting and fully reclining or lying positions. This semi-reclining position is also designated as a television position.

The task underlying the present invention is to provide a convertible chair and an adjustment mechanism of the type set out above which has as simple a construction as possible but so that, although the facility exists of effecting a simple adjustment, i.e. with minimum effort, desired intermediate positions can be selected between the two end positions and indeed without the use of special stop devices.

In accordance with the present invention there is provided a convertible chair which is adjustable between sitting and reclining positions and which comprises a support frame, a seat and a backrest of which the seat and backrest are tiltably mounted and are coupled together via parts of an adjustment mechanism which are tiltable relative to one another, the chair being characterized in that at least one support element with a curved support surface is provided for supporting the seat and is pivotably mounted at a pivot mount to the support frame at a distance from the pivot point axis of the seat and that said at least one support element is connected with the backrest via a control linkage for adjusting the vertical height of the point of support of the seat on said curved support surface.

By the use of at least one support element with a curved support surface which serves to directly support the seat and the curved form of which can be chosen for the purpose of predetermining the optimum inclination of the seat with respect to the associated inclination of the backrest, there results a range of continuous adjustability and adjustment to any point in this range can be effected with little effort or exertion. It is of especial advantage that stable conditions are achieved in desired inclinations without the need for any additional location or latch devices. In this way an optimum degree of comfort is ensured.

The support element preferably has an actuating lever which extends at an angle to the curved support surface and which is pivotably connected with the control linkage. This control linkage can extend beneath the seat and can preferably be connected with a downwardly extending extension of the backrest. It is however also possible to provide a linkage which extends between the backrest and an upwardly directed lever which is connected with the curved support element and which simultaneously forms at least a component of an armrest of the chair.

A further advantageous embodiment of the invention is characterized in that a fitting which is fixed to the support frame has an upwardly extending extension, or a corresponding separate extension connected to the support frame, is provided and that a pivot mount for a backrest carrier is formed at the free end of this extension. In this connection a support linkage which is fixedly connected with the seat is preferably attached to the backrest carrier at a distance from the pivot mount for the backrest.

This variant has the advantage that the seat, during the transition into a reclining position, firstly moves somewhat forwardly which makes it possible, in an upholstered chair, to use a so-called T-seat cushion the forward zone of which extends outwardly over the side parts of the chair and which receives, on account of this forward movement of the seat during the transition into the reclining position, sufficient freedom for a lifting movement.

Usefully a leg support mechanism, which is guided via at least one linkage which is pivotally connected to the curved support element, is pivotally mounted in the vicinity of the forward end of the seat. In this connection an additional linkage with a slot guide for a pin attached to the curved support element is preferably provided between the region of pivotal connection of the leg support mechanism on the seat and the curved support element such that this additional linkage with the longitudinal slot guide, on the one hand, limits the maximum chair inclination and, on the other hand, forms a pivot and retaining support in the zone of the retracted position of the leg support mechanism. The latter has the advantageous consequence that the leg support mechanism always reaches the fully retracted position in a trouble free manner and is held in this retracted position.

Finally, in accordance with a further advantageous feature of the invention a tension spring is arranged between the curved support element and the seat. By means of this spring, which is arranged in the vicinity of the pivot mount of the curved support element and which extends substantially vertically in the sitting position of the chair, it can be arranged that specified positions of the chair are preferentially stabilized and indeed usefully the sitting position in which the leg support mechanism must be held in the retracted condition and a selectable reclining position.

Figure 1A:
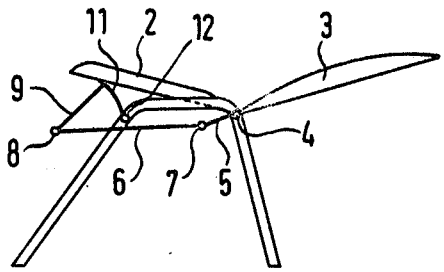
Figure 2:
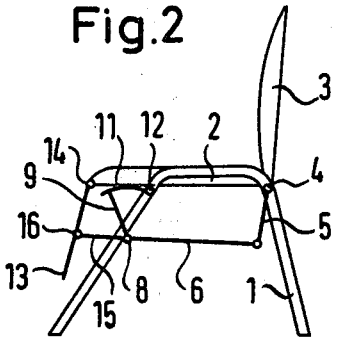
Figure 2A:
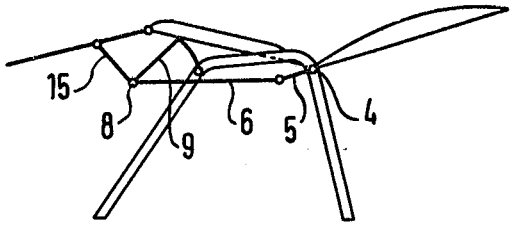
Figure 3:
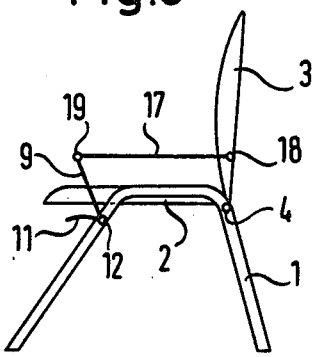
Figure 3A:
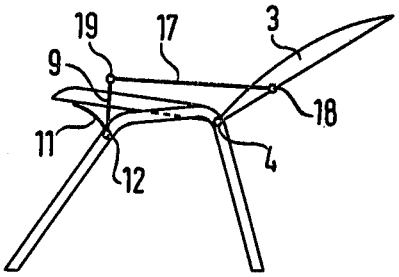
Figure 4:
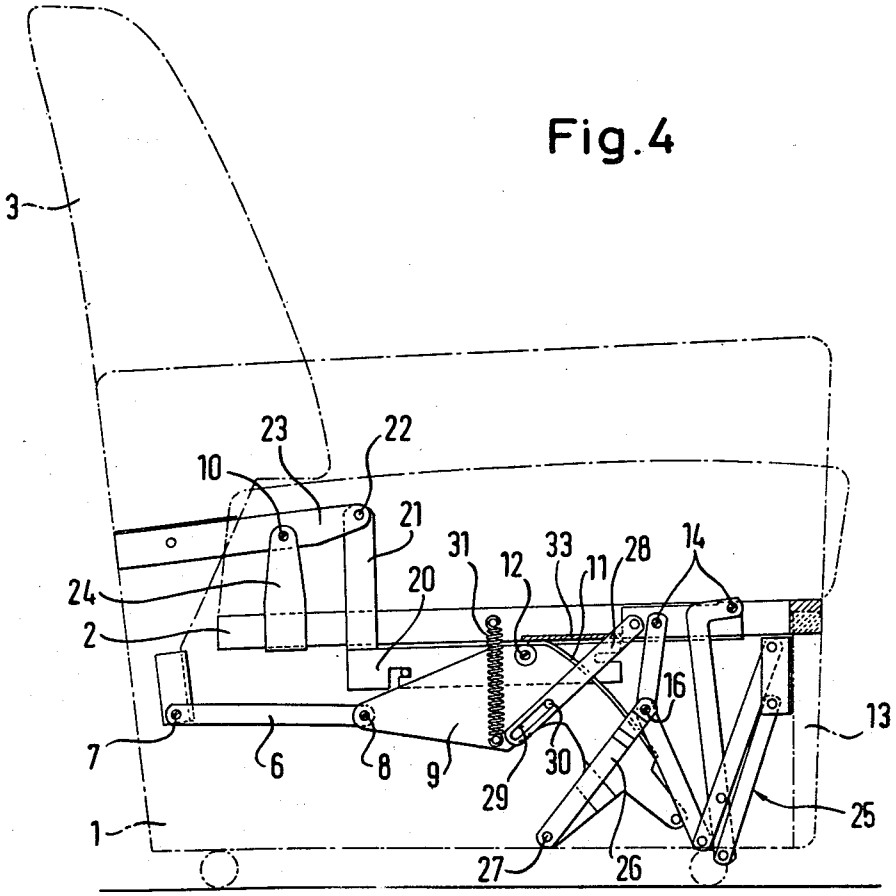
Figure 5:
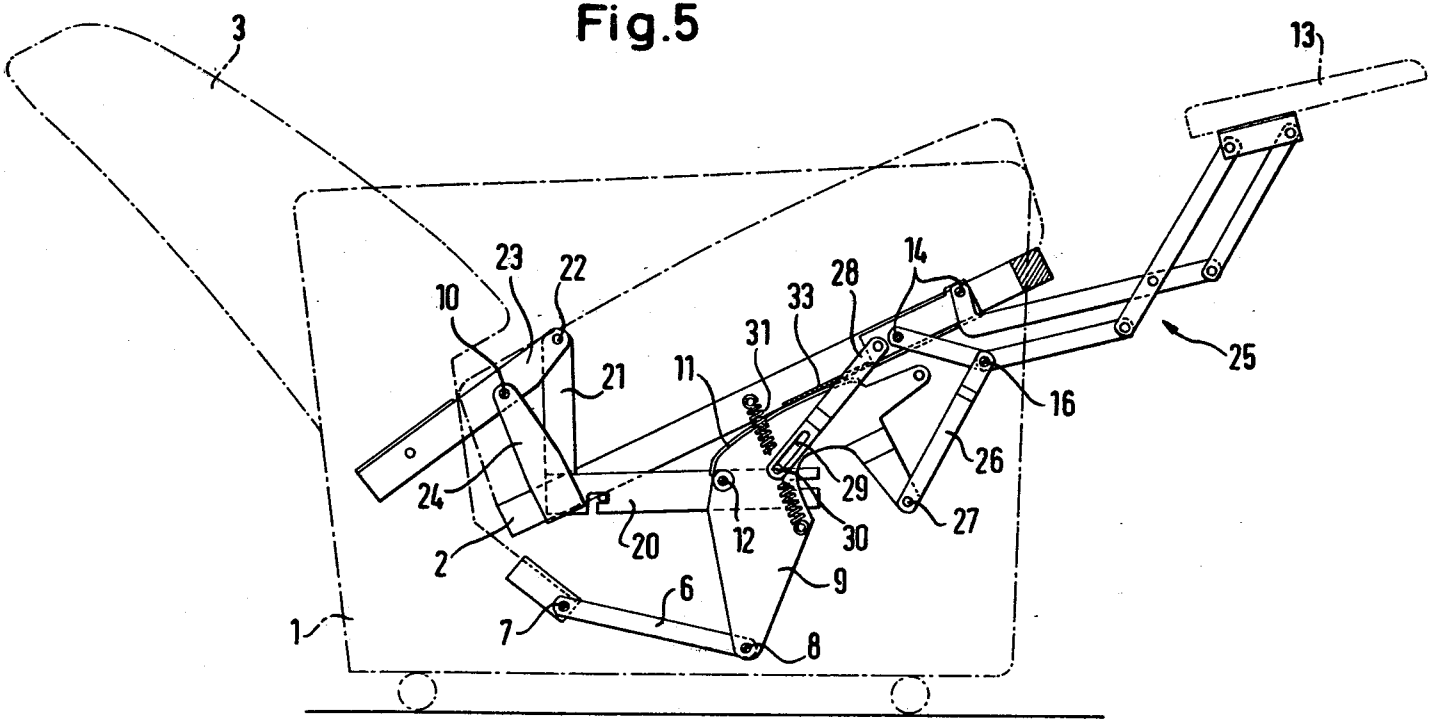

The invention will now be explained in more detail by way of example only and with reference to the drawings in which are shown:

FIG. 1—a schematic side view of a chair equipped with an adjustment mechanism in accordance with the invention and illustrated in the sitting position, FIG. 1*a*—the chair of FIG. 1 in the reclining position, FIG. 2—a schematic side view of a chair which is equipped with an adjustment mechanism and which also incorporates a leg support mechanism and is illustrated in the sitting position, FIG. 2*a*—the chair of FIG. 2 in the reclining position, FIG. 3—a schematic illustration of a chair in the sitting position and incorporating a further embodiment of an adjustment mechanism in accordance with the invention, FIG. 3*a*—the chair of FIG. 3 in the reclining position, FIG. 4—a side elevation of an upholstered chair in the sitting position showing further constructive details and which is provided with an adjustment mechanism in accordance with the invention, and FIG. 5—the chair of FIG. 4 shown in the reclining position.

The chair or easy chair of FIG. 1 has a seat 2 and a backrest 3 which are pivotably and tiltably mounted together at a hinge 4. The seat 2 and the backrest 3 are carried by a support frame 1 which is likewise fastened to the common pivot or hinge axis 4.

The backrest 3 is provided with an extension 5 which extends beyond the common pivot axis 4 and a control linkage 6 is pivotally connected to this extension at a pivot point 7. The other end of the control linkage 6 is connected via a pivot 8 with a straight actuating lever 9 of a support element with a curved support surface which is attached beneath the seat 2 and forms a support for the seat 2. The free end of the curved support element 11 is pivotably mounted to the support frame 1 about a pivot axis 12.

If a person sits on the chair in the position shown in FIG. 1 and leans backward whilst exerting a light pressure the backrest 3 pivots about the axis 4 and the linkage 6 is simultaneously pushed in the direction of the forward end of the seat 2. As a result the curved support element 11 is moved in the clock-wise sense about the axis 12 and thus the curved support element "rolls off" on the lower surface of the seat 2. By reason of the shaping of the curved support element 11 the inclination of the seat part 3 is matched in a predeterminable manner to the associated instantaneous inclination of the backrest 3.

If in the reclining position of FIG. 1*a* the pressure on the backrest 3 is somewhat removed then the body weight of a person located in the chair and pressing on the seat 2 brings about a reverse sequence of the procedure described above, i.e. the chair is once again moved in the direction of the sitting position and can either be returned wholly to the sitting position or can be halted in any desired intermediate position.

The chair illustrated in FIGS. 2 and 2*a* is provided with a footrest 13 which is hingedly connected with the forward end of the seat 2 at a pivot point 14. A short connecting rod 15 is pivotably connected at one end with the linkage 6 at the pivot point 8 of this linkage on the curved support element 11 whilst the other end of the connecting rod 15 is pivotally connected to a pivot point 16 of the leg support mechanism.

As can be seen from FIGS. 2 and 2*a* the displacement of the linkage 6 brought about by inclination of the backrest 3 results in a lifting of the leg support 13 upwardly and indeed because of the effect of the connecting rod 15.

In the embodiment of the chair in accordance with the invention as shown in FIGS. 3 and 3*a* an armrest 17 is provided which is connected with the backrest 3 at a pivot point 18.

The armrest 17 thus corresponds to the linkage 6 in the embodiments of FIGS. 1 and 2. The curved support element 11 is thus rigidly connected with an upwardly extending actuating lever 9 and the armrest 17 is connected at a pivot point 19 to this actuating lever 9.

As can be seen from FIGS. 3 and 3*a* the arm support 17 pulls the actuating lever 9 in the clock-wise direction when the chair is brought from the sitting into the reclining position. As a result the curved support element 11 is pivoted and the seat 2 is raised because of the shape of the curved support element.

A leg support mechanism can also be used with this variant in the same manner as with the embodiment of FIGS. 2 and 2*a*.

The upholstered chair of FIG. 4 which is provided with a preferred embodiment of an adjustment mechanism in accordance with the invention, includes once more a support frame 1, a seat 2 and a backrest 3 but in this embodiment the seat and backrest no longer have a common pivot axis.

The backrest 3 is fastened via a backrest carrier 23 at a pivot mount 22 to an upwardly extending extension of a fitting 20 which is fixed to the support frame. The seat 2 is hung from the backrest carrier 23 via a support linkage 24 which is rigidly connected to the seat and is pivotably mounted at the pivot point 10 which defines the pivot axis for the seat. Pivoting of the backrest rearwardly about the pivot axis 22 accordingly displaces the pivot point 10 of the support arm 24 somewhat in a forward direction which prevents the seat cushion being drawn rearwardly between the side parts at the beginning of the backrest movement as occurs with known adjustment mechanisms of this kind. This signifies that in contrast to known solutions, the adjustment mechanism in accordance with the invention can also be used with so-called T-cushions.

The curved support element 11 on which the seat 2 directly bears is fastened to the support frame 1 via a pivot mount 12 approximately in the vicinity of the center of the chair. The seat 2 is preferably provided with a synthetic or plastic insert 33 in the region of the support surface. The curved support element can have a widened support surface at the region which directly cooperates with the seat, for example in the form of a correspondingly curved flat iron strip.

The actuating lever associated with the curved support element is formed in the illustrated embodiment by a corner region of the curved support element which is generally of approximately triangular form. In this arrangement the linkage 6 which is likewise hingedly connected to the armrest at a pivot point 7 engages at a pivot point 8 on one corner of the triangle.

If a pressure is exerted on the backrest 3 and pivots the backrest about the pivot axis 22 the linkage 6 pivots the curved support element 11 in the counter clock-wise direction about the pivot axis 12 so that the seat 2 is raised in correspondence with the curved support surface of the curved support element. This results in the position illustrated in FIG. 5.

A leg support mechanism 25 the basic form of which is known in principle is pivotally connected at the pivot points 14 to the forward end of the seat 2. The leg support mechanism 25 carries a leg support or legrest 13 and is actuated via a linkage 26 which is arranged between a pivot point 16 on the leg support mechanism and a pivot point 27 on the curved support element 11. This pivot point 27 of the curved support element is located on a downwardly directed extension of the curved support element.

If the chair is moved from the position shown in FIG. 4 in the already mentioned manner into a reclining position the leg support mechanism is also extended via the linkage 26 and adopts the position shown in FIG. 5.

An additional linkage 28 is further provided between the curved supporting element and the vicinity of the pivot mounting of the leg support mechanism to the seat 2. The additional linkage 28 is pivotably connected to the seat 2 and is pivotably and displaceably mounted on the curved support element 11. For this purpose the additional linkage has an elongate slot 29 (otherwise referred to as a slot guide) at its end adjacent to the curved support element and a headed bolt or pin 30 which is fixedly attached to the curved support element 11 engages into this slot.

If the chair is in an extreme reclining position the bolt 30 abuts the outward lying end of the elongate slot 29 and in this way limits the maximum reclining position.

A further important function is fulfilled by this additional linkage 28 directly before the sitting position is reached and in the sitting position. On retraction of the leg support mechanism the retraction force for the leg support mechanism which is generated via the curved support element and the linkage 26 namely becomes smaller and finally zero in the last phase of movement which could result in the retraction process for the leg support mechanism not being completely brought to a final conclusion or, in the leg support mechanism not being held in a completely troublefree manner in the retracted position. This undesired effect is removed by the additional linkage 28 the elongate slot of which is so dimensioned that, in the closure phase of the retraction of the leg support mechanism, the bolt 30 comes into abutment with the seat end of the elongate slot. This has the consequence that the force introduced via the seat 2 generates a moment via the bolt 30 and the pivot point of the additional linkage which presses the leg support mechanism into the end position. In this way a troublefree retraction of the leg support mechanism into its end position is possible even when a retraction force can no longer be exerted via the curved support element.

A tension spring 31 is provided between the curved support element 11 and the seat 2 the effect of which aids the operation and accordingly also assists, in the sitting position, in holding the leg support mechanism without trouble in the retracted position and. Moreover the arrangement of this tension spring is so chosen that for a selectable reclining position, in particular the so-called television position a stabilizing effect is developed. This tension spring 31 is however not absolutely necessary to the operation because the adjustment mechanism, in accordance with the invention, makes it possible on account of its trimmed balanceability, to endow each intermediate position with sufficient stability.

It should also be mentioned that in general an adjusting mechanism of the kind illustrated in the drawings is used at both respective sides of a chair however that it is also possible in principle to use an embodiment with a centrally arranged single adjustment mechanism. In similar manner it is possible to use throughgoing axes which respectively connect two adjustment mechanisms instead of individual pivot points for each adjustment mechanism.

Further modifications of the above described chairs and adjustment mechanisms will be apparent to those skilled in the art without departing from the scope of the present teaching. In particular it will be appreciated that the precise relationship between the tilted inclinations of the backrest and the seat, and if provided also of the footrest are determined by the length and dispositions of the various levers and pivot points and on the precise profile of the curved support surface if the support element and its disposition relative to its associated pivot point.

We claim:

1. A convertible chair which is adjustable between sitting and reclining positions and which comprises a support frame; a seat having front and rear ends and a lower surface; a backrest; means tiltably mounting said seat and said backrest for tilting movement about respective axes extending transversely of said chair; and an adjustment mechanism for coupling the seat and backrest together so that tilting movement of said backrest results in corresponding tilting movement of said seat, said adjustment mechanism comprising at least one support element having an elongate part with an elongate curved support surface for supporting said seat, said curved support surface having front and rear ends, an actuating lever rigidly connected to said support element, pivot means for pivotally mounting said support element to said support frame for rotation about a pivot axis extending through said support element directly adjacent said rear end of said curved support surface and a control linkage extending from said lever to said backrest, whereby tilting of said backrest about the respective transverse axis produces a rotation of said support element about said pivot axis to adjust the vertical height of the point of support of the seat on said curved element in dependence on the position of the backrest, and wherein the curved surface of said support element is so arranged and it rolls off on the lower surface of the seat during rotation about said pivot axis so that the point of support of said seat on said curved support surface moves progressively forwardly from said pivot axis during movement of said seat and backrest to a fully reclining position and progressively rearwardly towards said pivot axis during the return movement, so that the turning moment which the seat exerts on the curved support element balances the varying turning moment exerted on the curved support element by the backrest, in all positions.

2. A convertible chair according to claim 1 wherein said actuating lever extends at an angle to said part.

3. A convertible chair according to claim 2 wherein said control linkage comprises a straight link with front and rear ends, with said straight link being pivotably connected at its front end of said actuating lever and at its rear end to the backrest or to an extension of the backrest.

4. A convertible chair according to claim 3 wherein said straight link forms at least a component of an arm rest of the chair.

5. A convertible chair according to claim 1 wherein said pivot means is disposed in the vicinity of the center of said seat.

6. A convertible chair according to claim 1 wherein the transverse axes respectively associated with said seat and said backrest are common.

7. A convertible chair according to claim 1 and further comprising a leg support mechanism, an operating linkage for deploying said leg support mechanism from a stowed position to an extended position on adjustment of said chair from said sitting position to said reclining position, wherein said operating linkage includes a guide link pivotally connected at one end to said support element, and wherein said pivot means for said support element, the point of pivotal connection of said control linkage to said support element and the point of pivotal connection of said guide link to said support element from the corner points of a triangle.

8. A convertible chair according to claim 7 wherein said triangle is a substantially isosceles triangle the apex of which is determined by said pivot means for the support element.

9. A convertible chair according to claim 7 wherein said operating linkage includes at least one mounting link pivotally connected to said seat adjacent the front end thereof, wherein an additional link extends from said support element to said seat adjacent the point of pivotal connection of said mounting link to said seat and wherein a pin is provided on said support element and a slot guide in said additional link, with said pin engaging in said slot guide and cooperating, in said reclining position, with a rear end of said slot guide to limit the maximum inclination of the chair and, in said sitting position, with a front end of said slot guide to press said support element and thus said footrest back into the stowed position.

10. A convertible chair according to claim 1 wherein a tension spring is arranged between the support element and the seat.

11. A convertible chair in accordance with claim 1 and wherein a single support element is provided and is disposed substantially in the middle of the chair.

12. A convertible chair according to claim 1 and in which two said support elements are provided and are disposed one to either side of the chair.

13. A convertible chair which is adjustable between sitting and reclining positions and which comprises a support frame; a seat having front and rear ends and a lower surface; a backrest; means tiltably mounting said seat and said backrest for tilting movement about respective axes extending transversely of said chair; and an adjustment mechanism for coupling the seat and backrest together so that tilting movement of said backrest results in corresponding tilting movement of said seat, wherein said means tiltably mounting said seat and said backrest comprises first and second parts fixed to said support frame on respective sides of said seat, first and second upwardly extending extensions provided on respective ones of said first and second parts adjacent said backrest, first and second backrest carriers secured to respective sides of said backrest, first and second pivot mounting for respective ones of said first and second backrest carriers at respective free ends of said first and second upwardly directed extensions, and first and second support linkages fixedly connected with said seat at respective sides thereof, said first and second support linkages being pivotally connected to respective ones of said first and second backrest carriers at points spaced apart rearwardly from said first and second pivot mountings and wherein said adjustment mechanism comprises at least one support element having an elongate part with an elongate curved support surface for supporting said seat, said curved support surface having front and rear ends, an actuating lever rigidly connected to said support element, pivot means for pivotally mounting said support element to said support frame for rotation about a pivot axis extending through said support element directly adjacent said rear end of said curved support surface and a control linkage extending from said lever to said backrest, whereby tilting of said backrest about the respective transverse axis produces rotation of said support element about said pivot axis to adjust the vertical height of the point of support of the seat on said curved element in dependence on the position of the backrest, and wherein the curved surface of said support element is so arranged that it rolls off on the lower surface of the seat during rotation about said pivot axis so that the point of support of said seat on said curved support surface moves progressively forwardly from said pivot axis during movement of said seat and backrest to a fully reclining position and progressively rearwardly towards said pivot axis during the return movement, so that the turning moment which the seat exerts on the curved support element balances the varying turning moment exerted on the curved support element by the backrest, in all positions.

* * * * *